United States Patent [19]

Foulds

[11] 4,037,087

[45] July 19, 1977

[54] ROLLING MILL CONTROL METHOD AND APPARATUS HAVING OPERATOR UPDATE OF PRESETS

[75] Inventor: John G. Foulds, Bethlehem, Pa.

[73] Assignee: Bethlehem Steel Corporation, Bethlehem, Pa.

[21] Appl. No.: 690,748

[22] Filed: May 27, 1976

[51] Int. Cl.[2] ..... B21B 37/12; G06F 9/06

[52] U.S. Cl. ..... 235/151.1; 72/8; 364/300

[58] Field of Search ..... 235/151.1; 340/172.5; 444/1

[56] References Cited

U.S. PATENT DOCUMENTS

| | | | |
|---|---|---|---|
| 3,094,609 | 6/1963 | Weiss et al. | 235/157 |
| 3,309,675 | 3/1967 | Burt | 340/172.5 |
| 3,332,263 | 7/1967 | Beadle et al. | 72/7 |
| 3,700,379 | 10/1972 | Robertson | 444/1 |

OTHER PUBLICATIONS

"Computer Control of Sparrows Point 56 Hot Strip Mill", by G. F. Heck et al. -Paper presented to AISE Rolling Mill Conference, Baltimore, Md., May 4–6, 1970.

*Primary Examiner*—Eugene G. Botz

*Attorney, Agent, or Firm*—Joseph J. O'Keefe; John I. Iverson; George G. Dower

[57] ABSTRACT

Rolling mill computer control system includes an operator update program which accepts requests from a mill operator to modify computer setups for speed and screwdown presets. When under computer control and abnormal mill conditions arise, the computer programs will accept operator updates from the same presetting devices which are used in manual operation. The operator update program calculates speed and draft coefficients which are used to update the basic computer schedule calculations so as to accommodate the abnormal mill conditions. Additional presetting devices, such as load distribution switches, are eliminated so as to minimize operator confusion and simplify operator panel layout.

28 Claims, 2 Drawing Figures

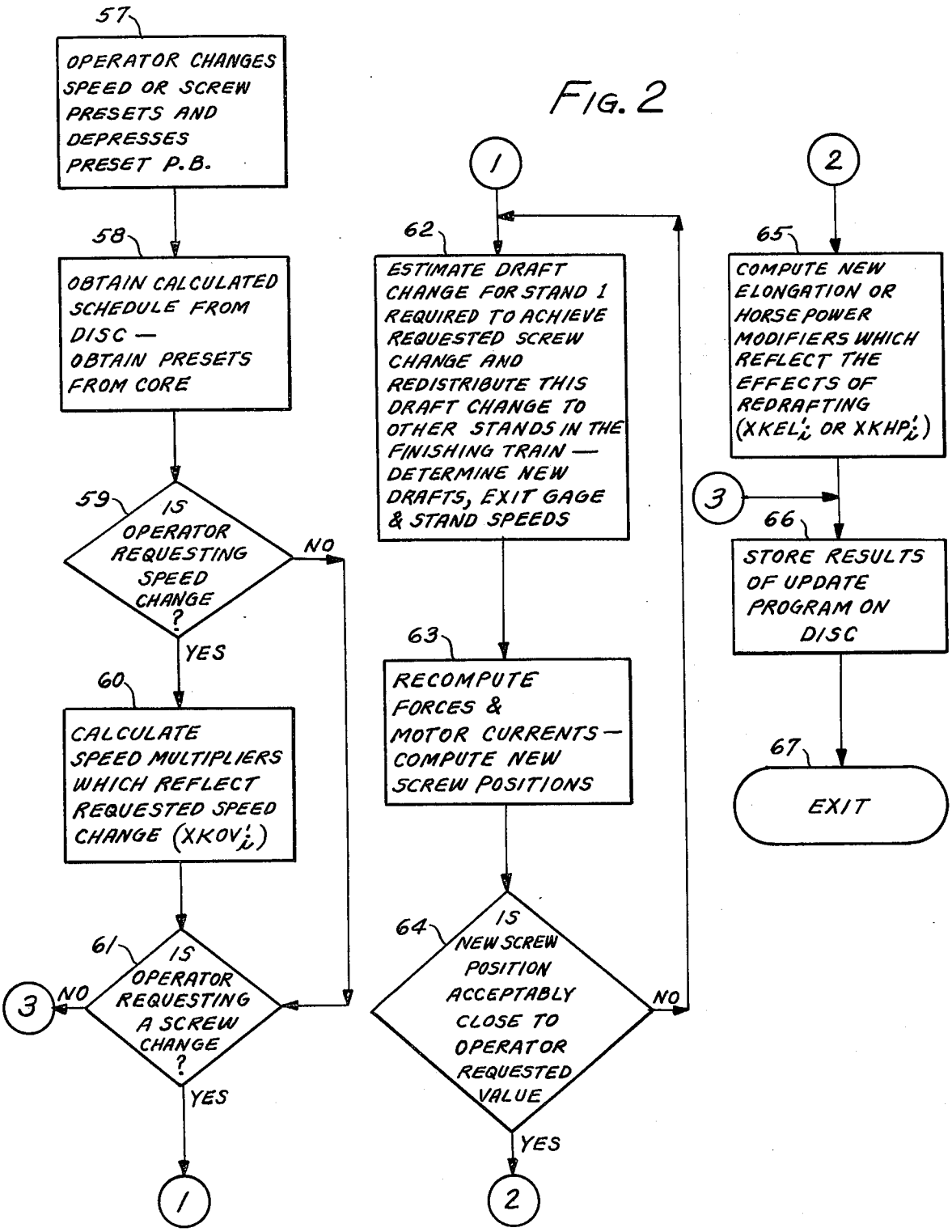
FIG. 2
57
OPERATOR CHANGES SPEED OR SCREW PRESETS AND DEPRESSES PRESET P.B.
58
OBTAIN CALCULATED SCHEDULE FROM DISC — OBTAIN PRESETS FROM CORE
59
IS OPERATOR REQUESTING SPEED CHANGE ?
NO
YES
60
CALCULATE SPEED MULTIPLIERS WHICH REFLECT REQUESTED SPEED CHANGE (XKOV'i)
61
IS OPERATOR REQUESTING A SCREW CHANGE ?
3
NO
YES
1
1
62
ESTIMATE DRAFT CHANGE FOR STAND 1 REQUIRED TO ACHIEVE REQUESTED SCREW CHANGE AND REDISTRIBUTE THIS DRAFT CHANGE TO OTHER STANDS IN THE FINISHING TRAIN — DETERMINE NEW DRAFTS, EXIT GAGE & STAND SPEEDS
63
RECOMPUTE FORCES & MOTOR CURRENTS — COMPUTE NEW SCREW POSITIONS
64
IS NEW SCREW POSITION ACCEPTABLY CLOSE TO OPERATOR REQUESTED VALUE
NO
YES
2
2
65
COMPUTE NEW ELONGATION OR HORSE POWER MODIFIERS WHICH REFLECT THE EFFECTS OF REDRAFTING (XKEL'i OR XKHP'i)
3
66
STORE RESULTS OF UPDATE PROGRAM ON DISC
67
EXIT

ROLLING MILL CONTROL METHOD AND APPARATUS HAVING OPERATOR UPDATE OF PRESETS

BACKGROUND OF THE INVENTION

1. Field of the Invention

This invention relates broadly to rolling mill control methods and apparatus. More particularly, this invention relates to a computer method and apparatus for controlling a rolling mill wherein there is included an operator update program for presetting and changing operating parameters. The invention may be used in a hot strip rolling mill, as will be referred to herein, or in other rolling mills for rolling sheets, plates, bars, billets, slabs and the like.

2. Description of the Prior Art

In a typical computer-controlled hot strip rolling mill, rolling schedule calculations for a finishing train are frequently initiated when a slab passes through the last roughing stand. A computer program for calculating a rolling schedule combines appropriate order data, such as grade, width, desired gage, etc., with operating data, such as slab thickness and temperature measurements, to generate computer reference setups involving a different set of roll speed and screwdown presets for each stand in the finishing train.

Presently, there are two major approaches to computing the reference setups for each mill stand. The first begins with computing a normal load distribution and presetting corresponding switches. Load distribution is then converted into percent reduction, desired roll force, roll speed and screw position presets for each stand. The second approach begins directly with computing a normal reduction pattern and after generating a schedule of speed and screw presets for each stand, a check is made to insure that an acceptable load distribution has been achieved.

When the computer is off-line, separate speed and screwdown preset thumbwheel switches provide manual controls for establishing the reference setups for each mill stand. Therefore, when using the first on-line approach to computing the reference setups, the mill operator's desk would normally include two different groups of manually operable switches, namely, the load distribution switches and the speed and screwdown preset switches for operator/computer interfacing. Whereas, when using the second on-line computing approach, only the preset switches would normally be included on the operator's desk.

Ideally, when the rolling mill control computer is on-line, the schedule calculations will proceed normally so that maximum quality and throughput of rolled product are achieved. However, as is sometimes the case, abnormal mill conditions arise which require human intervention to manually modify the computer-generated speed and screwdown reference setups. Manual changes are sometimes necessary to control the rolled product shape because of worn rolls, because of undesirable mill threading, to balance motor loads when the load distribution is undesirable, to adjust temperature of the rolled product, or occasionally to overcome false automatic control signals.

When abnormal conditions arise, the operator is first confronted with the problem of making rapid decisions concerning the schedule modifications required to avoid rolling large batches of off-specification product. He is next confronted with the problem of determining whether or not the rolling mill control system will accept operator requests for modifications to computer-generated speed and screwdown setups, and if so, by what means these operator requests will be accepted. The operator must then decide whether his requests will be implemented by a second or manual set of preset devices which were added on an operator's desk alongside of a set of load distribution switches which are utilized in computer-generated setups. Alternatively, operator requests may be implemented by a second set of preset devices located alongside of a first set normally used for manual operation. In still another arrangement, particularly in older mill installations, the operator's desk may already be overcrowded so that the addition of an extra set of controls for implementing the operator's requests may have to be placed elsewhere rather than in its logical location. Thus, at this moment of decision-making, the operator is confused and subject to considerable mental adjustments in order to overcome abnormal rolling conditions.

SUMMARY OF THE INVENTION

One of the objects of this invention is to provide an improved method and apparatus for automatically controlling rolling mills.

Another object of this invention is to provide a computer method and apparatus for controlling a rolling mill which minimizes operator confusion when transferring from computer to manual operation.

Still another object of this invention is to provide a computer method and apparatus for controlling a rolling mill in which improvements may be made in older mills without overcrowding the existing operator's control desk.

The foregoing objects are attainable by a computer-controlled rolling mill method and apparatus which, in addition to having a rolling schedule calculation program for generating operating reference setups, includes an operator update program for enabling an operator to make on-line requests for adjustments to the calculated setups and to implement these requests by using the same set of preset switches during on-line rolling that are used by the operator when the computer is off-line. The operator update program is initiated by preset pushbuttons and produces and stores reference setup modifiers, such as roll speed and screwdown modifiers, which are held until another change in a preset is made, or until changed by schedule calculations. The operator update program may be used with either type of the above-noted approaches to computing the reference setups without requiring load distribution switches. The advantage of using one set of input devices for both manual and computer control is that it lessens the mental adjustments required when switching between the two modes of operation. In addition, it minimizes the addition control devices that must be added to control desks to accommodate the computer control function.

BRIEF DESCRIPTION OF THE DRAWINGS

FIG. 2 is a flow diagram of the operator update program used in the FIG. 1 embodiment.

DESCRIPTION OF THE PREFERRED EMBODIMENT

Figure 1:
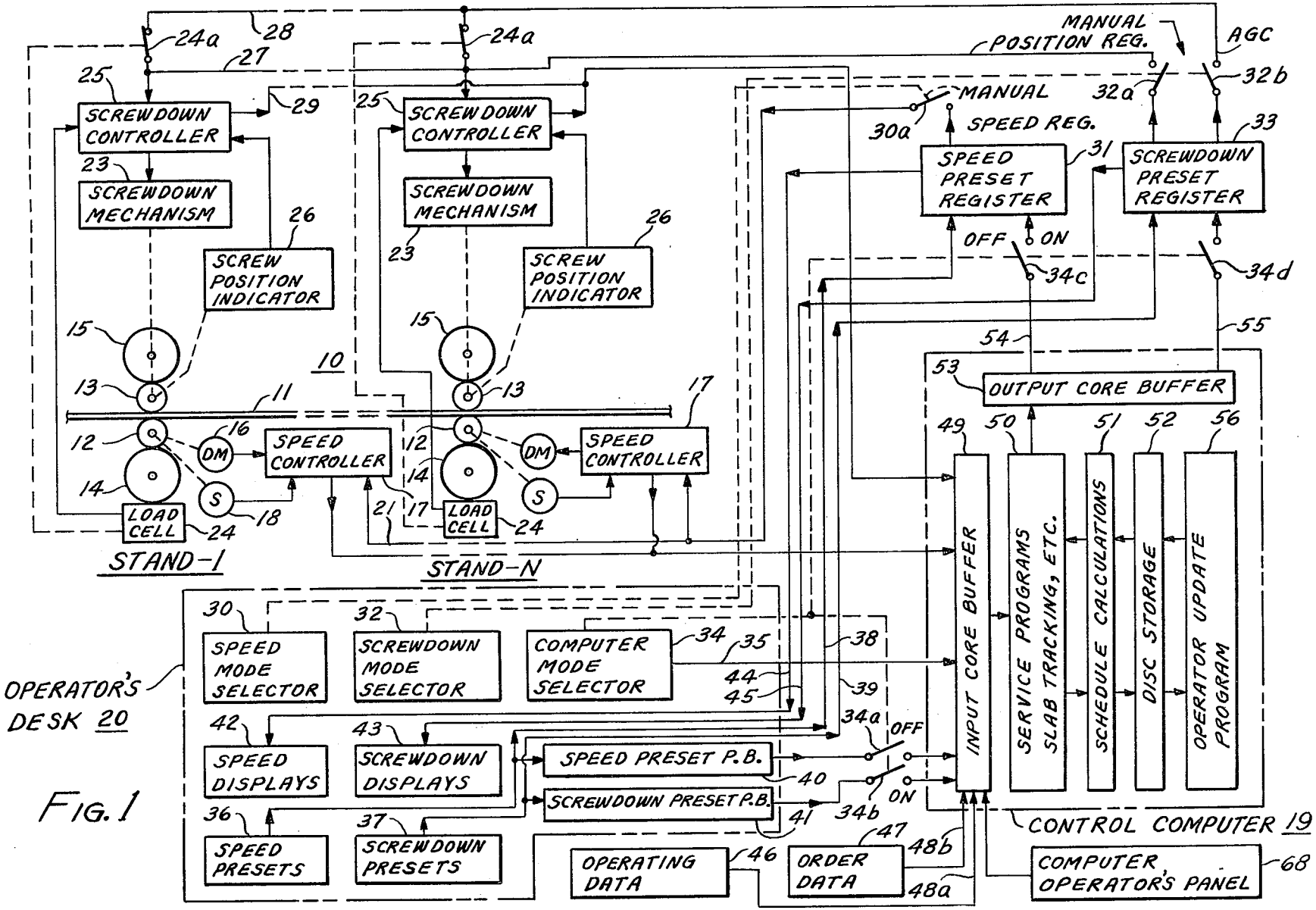
FIG. 1 is a block diagram of a hot strip rolling mill having computer-controlled speed and screwdown control circuits and including the operator update program embodiment of the present invention.

In FIG. 1, there is shown a conventional computer-controlled hot strip rolling mill 10 having a plurality of stands in a finishing train, labeled STAND-1 through STAND-N, which produces hot rolled strip 11. Typically, each stand in the finishing train is provided with a pair of work rolls 12 and 13 and a pair of backup rolls 14 and 15 for successively reducing strip 11 thickness according to well known mass-flow methods.

Each work roll 12 is powered by a respective drive motor 16 operating in individual automatic speed control loops under control of respective speed controllers 17 and a speed feedback signal from sensors 18. Control computer 19, under control of operator's desk 20, supplies separate speed preset signals over bus 21 to each speed control loop in the finishing train, and also receives respective speed and horsepower signals from each speed controller 17 over bus 22, both as will be described below.

Each work roll 13 is positioned by a separate screw-down mechanism 23 operating in individual automatic roll position control loops under control of respective screwdown controllers 25. Each controller 25 receives a corresponding position feedback signal from screw position detector 26 and a roll force signal from load cell 24 when strip 11 is in the stand. Each load cell 24 also causes switch 24*a* to open whenever a bar or strip is in the respective stand. Control computer 19, also under control of operator's desk 20, supplies separate screwdown preset signals over either bus 27 or 28 to each roll position control loop in the finishing train, and receives respective screw position and roll force signals from each screwdown controller 25 over bus 29, both as will be described below.

Operator's desk 20 provides several means for an operator to set up and control the various control loops in mill 10, as well as to implement an operator update program in computer 19. Speed mode selector 30 provides the operator with two positions for establishing the speed control loops in either a manual mode or a speed-regulate mode of operation. During the first, or manual, mode switch contact 30*a* is open and an operator is permitted to run the speed controllers 17 manually. During the second, or speed regulate, mode switch contact 30*a* is closed and speed preset register 31 provides the source of speed preset signals to be sent through closed contact 30*a* and over bus 21 to each speed controller 17.

Screwdown mode selector 32 provides the operator with three positions for establishing the roll position control loops in either a manual mode the same as the speed control loops, a position regulate mode, or an AGC mode of operation. During the first, or manual, mode switch contacts 32*a* and 32*b* are open. During the second, or position-regulate, mode switch contact 32*a* is closed and screwdown preset register 33 provides the source of screwdown preset signals that are applied over bus 27 to each screwdown controller 25, thereby enabling the operator to establish the gap between work rolls 12 and 13 or without a bar or strip being present in mill 10. During the third, or AGC, mode switch contact 32*b* is closed and register 33 provides the screwdown preset signals over bus 28, through contacts 24*a* to each screwdown controller 25, thereby enabling the operator to change mill screw position only when metal is not present in the mill 10.

Included in operator's desk 20 is computer mode selector 34 which provides the operator with two positions, on or off, for establishing control computer 19 in either an on-line or an off-line mode of operation. Corresponding signals are fed over bus 35 to computer 19. During the off-line mode, switch contacts 34*a*, 34*b*, 34*c* and 34*d* are open to prevent computer 19 from receiving manually set preset signals and to prevent computer 19 from controlling mill 10. Registers 31 and 33 receive the manually set speed and screwdown preset signals directly over buses 38 and 39 and under speed- and screwdown-regulate modes, feed these signals over buses 21, 27 and 28 to corresponding speed- and screwdown-controllers 21 and 25. This enables the operator to cause mill 10 to operate manually during the computer off-line mode of operation.

When computer mode selector 34 is in the on-line mode, switch contacts 34*a*, 34*b*, 34*c* and 34*d* are closed to permit computer 19 to receive manual changes in speed and screwdown preset signals and to initiate automatic control of mill 10 as will be explained below. At the same time, if the speed and position-regulate modes are selected, any preset inputs will go directly into the appropriate controllers 17 or 25 resulting in an instantaneous response to the operator's requested change.

Operator's desk 20 also provides speed presets 36 and screwdown presets 37 for the operator to establish the corresponding preset signals mentioned above. Each preset device 36 and 37 contains a group of thumbwheel switches for each stand in the rolling mill finishing train. This arrangement enables the operator to set up mill 10 manually, based on known order and operating data, by causing any one or all of the speed and screwdown preset signals to be fed over corresponding buses 38 and 39 directly to respective preset registers 31 and 33 when computer 19 is in the off-line mode as noted above. Simultaneously, the speed and screwdown signals on buses 38 and 39 are fed under control of speed and screwdown pushbuttons 40 and 41 through switch contacts 34a and 34b to control computer 19, when computer 19 is in the on-line mode as described above, for the purpose of adjusting or changing computer-generated speed and/or screwdown presets. Thus, it will be apparent that the same set of speed and screwdown preset devices 36 and 37 are used to both set up mill 10 manually as well as adjust or change computer-generated speed and/or screwdown preset values as will be described more fully below.

The mill operator is also provided with display facilities on operator's desk 20. These include speed displays 42 and screwdown displays 43, each of which contains a group of digital devices for each stand in the rolling mill finishing train. Speed and screwdown displays 42 and 43 are fed by respective buses 44 and 45 from corresponding preset registers 31 and 33. This arrangement will assure the operator that whatever he observes in these speed and screwdown displays will be what the mill is currently operating at, regardless of whether mill 10 is operating under computer 19 off-line or on-line mode of control.

In order that control computer 19 may calculate a rolling schedule, appropriate order data, such as grade, width, desired gage, etc., together with operating data, such as slab thickness and temperature measurements must be received by computer 19. Operating data signals are supplied by device 46 and order data signals are supplied by device 47 and fed over bus 48 to computer 19. Slab thickness may be determined by actual measurement (not shown), or by estimate from roll force and screw position readings on the last roughing stand (not shown). Slab temperature may be measured by a pyrometer at a delay table (not shown).

Control computer 19 typically includes an input core buffer 49 which receives (a) speed and horsepower signals over bus 29 from STAND-1 through STAND-N, (b) screwdown position and roll force signals from STAND-1 through STAND-N, (c) computer mode selector signals over bus 35, (d) changes in speed and screwdown preset signals over buses 38 and 39, and (e) operating data signals over bus 48*a* and order data signals over bus 48*b*. Under computer on-line and AGC mode of operation, service programs 50 assimilate the input signals in a conventional manner and compare actual with desired data signals, track slab as it enters each stand in the finishing train, and the like.

In addition, control computer 19 includes schedule calculations 51 and disc storage 52 which together take the appropriate order data signals and combine them with the operating data signals representing slab thickness and temperature. Just prior to a bar entering the finishing train, the schedule calculation program causes the production of speed reference and screwdown reference setting signals for each STAND-L through STAND-N in the finishing train. These reference setting signals are passed through output core buffer 53 by way of respective buses 54 and 55 to speed and screwdown preset devices 31 and 33, respectively. As mentioned above, with the computer on-line and the speed and screwdown controllers in operation, these speed and screwdown reference setting signals are fed over respective buses 21, 27 or 28 for the purpose of independently controlling each STAND-1 through STAND-N in the finishing train. The computer-generated presets also appear on speed and screwdown display devices 42 and 43, respectively. Actual speed and horsepower data signals and roll gap and roll force data signals are fed back over buses 22 and 29 for further processing by computer 19. Control corrections are made automatically to improve the computer-generated presets.

There are two major methods for schedule calculations 51 to cause control computer 19 to compute the speed and screwdown reference settings. The first is the normal load distribution method and the second is the normal reduction pattern method, both as described at the outset of this specification. The present invention may be used with either method of schedule calculations, although the latter method is preferred.

Referring now to both FIGS. 1 and 2, if after the bar enters the finishing train, the mill operator observes the speed and screwdown presets on display devices 42 and 43 and he decides that the computer setups have resulted in either an undesirable threading or mill loading, he may request a change to either the speed or screw position of any one or all stands in the finishing train. The operator simply enters the desired value in corresponding thumbwheel switches in speed or screwdown preset devices 36 or 37 and depresses respective preset pushbuttons 40 or 41. This corresponds to step 57 in the FIG. 2 flow diagram and the initiation of operator update program 56 in FIG. 1 which calculates speed or screwdown modifiers for the schedule-calculated reference settings.

Step 58 calls for obtaining the calculated schedule from disc storage 52 where it was placed by the schedule calculation just prior to the slab entering STAND-1, and the reading in of the new desired speed or screw position presets from input core buffer 49. Query is made in step 59 as to whether the operator is requesting a speed change. If the query is positive, program 56 proceeds to step 60 which calls for calculating an operator update speed multiplier for each stand which reflects the requested speed change as follows:

$$XKOV'_i = XKOV_i \times SPEED_i'/SPEED_i, \text{ where} \qquad \text{Eq. 1}$$

Subscript $i$ = stand number in the finishing train
Superscript $'$ = variable reflects effect of latest operator input
XKOV = speed multiplier generated from operator input
SPEED = speed of stand.

Operator update program 56 includes step 61 which queries as to whether the operator requested a screw change. If the query is negative, or in other words a speed change was requested, then program 56 advances to step 66 where each operator update speed multiplier XKOV from Eq. 1 is stored in disc storage 52. Here each speed multiplier is available for use as a mass-flow vernier in schedule calculations 51 for the next bar. Each speed multiplier may be retained until the operator's next input on any particular stand or, unless modification is required as described below, it may be reset to 1.0. The operator update program 56 exits at step after the last speed multiplier is stored on disc storage 52.

Returning now to step 59, if the query is negative, or in fact a screw change was requested by the operator, then program 56 advances to step 61 and on to step 62 which calls for first converting to an estimated draft change for each stand effected using a linear relationship as follows:

$$\Delta DRAFT_i = k_i \times \Delta SCREW_i, \text{ where} \qquad \text{Eq. 2}$$

ΔDRAFT = estimated incremental draft change resulting from requested draft change
$k$ = approximate relationship between incremental screw position and draft
$\Delta SCREW_i$ = SCREW'-SCREW, or change in screw position requested by operator.

Since the total draft from the finishing train entry to exit does not change, $\Delta DRAFT_i$ is redistributed to other stands in the finishing train in an amount proportional to the relative draft taken in each stand by the existing rolling schedule. Given a new set of drafts, and the aim gage for STAND-N, it is then possible to obtain a new set of exit gages for each stand and use these in the mass flow equations to obtain new stand speeds.

Step 63 calls for recomputing roll forces and drive motor 16 currents using the same models as are used for this purpose by schedule calculations 51. The drivemotor 16 currents are compared against their predetermined upper limits. A record of these motor currents is kept for use in schedule calculations 51 if any stands are found in a fully-loaded or overloaded condition. The new roll forces are combined with the aim gage for each stand, which is fed from order data 47, as well as various offset factors to produce new screw positions.

Step 64 calls for comparing the newly calculated screw positions with operator requested values to determine if the new screw position(s) are acceptably close to operator requested values. If not, steps 62 and 63 must be repeated using the last draft estimates as a starting point for another iteration.

When a satisfactory agreement of estimated draft changes has been reached, operator update program 56 advances to step 65 which calls for computing either new elongation or new horsepower modifiers for STAND-1 through STAND-N that reflect the effects of redrafting. If the schedule calculation 51 is of the elongation type, then new elongation modifiers are computed as follows:

$$XKEL_i = ELI_i'/ELIR_i, \text{ where} \qquad \text{Eq. 3}$$

XKEL = elongation multiplier reflecting effect of operator changes
ELI = entry divided by exit gage or elongation
ELIR = reference elongation reflecting manner in which computer would normally draft mill.

If the schedule calculation 51 is of the horsepower type, then new horsepower modifiers are calculated as follows:

$$XKHP_i = HP_i'/HPR_i, \text{ where} \qquad \text{Eq. 4}$$

$XKHP_i$ = horsepower multiplier reflecting effect of operator changes
HP = stand horsepower
HPR = reference horsepower reflecting manner in which computer would normally draft mill.

Upon completion of calculating the new elongation or horsepower modifiers from Eq. 3 or 4, as well as speed modifiers from Eq. 1, step 66 calls for storing the update modifiers in disc storage 52. Here these new modifiers are available for incorporation into the next schedule calculation 51 which will then reflect the requested change in subsequent mill operations. The original schedule upon which the modifier calculations are based is updated with the new elongation modifiers, drive motor 16 currents, interstand gage and screw positions. The original schedule 51 is rewritten on the disc storage 52 where it is available for use if subsequent manual inputs are received prior to another slab threading STAND-1. When this operation is completed, the operator update program 56 exits at step 67.

Operating experience has shown that certain important functions pertaining to the speed and screw position updates must be performed in the schedule calculations. It has been found that periodically the speed updates, that is XKOV from Equation 1, should be shifted towards unity to avoid accumulation of many inputs over a period of time which could grossly distort the computer's speed schedule. This can be done at each item change involving a major gage change of, for example, 0.010 inch to 0.020 inch for a hot strip mill, or may be based upon other rules for different installations.

It has also been found that elongation modifiers, that is XKEL from Equation 3, generated for one product will not be suitable if computer 19 must process strips 11 in a totally different gage range. The solution to this problem is to divide the total gage range into bands and have available on disc storage 52 at all times the elongation modifiers used in the schedule calculations when computer 19 last processed strips 11 in this range. Thus, whenever schedule calculations 51 pass from one band to the next a new set of elongation modifiers are taken from disc storage 52. This reflects changes in screwdown inputs the mill operator made when mill 10 was last operated in that gage range.

If for any reason the mill operator wishes to return to the actual computer-calculated schedule, this may be done by way of two switches which are included, but not shown, on computer operator's panel 68. One switch will reset the elongation multipliers XKEL to 1.0, while the other switch performs the same function for the speed multipliers XKOV.

I claim:

1. A method of controlling a rolling mill having a presettable operating parameter, which method comprises:

a. establishing a rolling schedule after receiving input data,
b. presetting the mill operating parameter to a reference level obtained from the rolling schedule and operating the mill parameter at said reference level during an automatic mode of operation,
c. calculating a modifier for the preset reference level during mill operation in response to an operator updating the parameter preset device, the same preset device being used for a second mode of mill operation, and
d. subsequently adjusting the mill operating parameter reference level proportional to the calculated modifier.

2. The method of claim 1 wherein the operating parameter is mill speed.

3. The method of claim 1 wherein the operating parameter is roll screw position.

4. The method of claim 1 wherein step (c) is performed by a programmed computer which includes an operator update program.

5. The method of claim 1 wherein steps (a) through (c) are performed by a programmed computer which includes schedulle calculation and operator update programs.

6. A method of controlling a multi-stand rolling mill having a presettable operating parameter for each mill stand, which method comprises:

a. establishing a multi-stand rolling schedule for each stand after receiving input data,
b. presetting the mill operating parameter for each stand at a corresponding reference level obtained from the rolling schedule and operating the mill parameter at said reference level during an automatic mode of operation,
c. calculating a modifier for the preset reference level of at least one stand during mill operation in response to an operator updating a corresponding parameter preset device, the same preset device being used for a second mode of mill operation, and
d. subsequently adjusting the mill operating parameter reference level of at least one stand proportional to a corresponding calculated modifier.

7. The method of claim 6 wherein the operating parameter for each stand is mill speed.

8. The method of claim 6 wherein the operating parameter for each stand is roll screw position.

9. The method of claim 6 wherein step (c) is performed by a programmed computer which includes an operator update program associated with each mill stand.

10. The method of claim 6 wherein step (d) adjusts the mill operating parameter reference level of a plurality of adjacent stands.

11. The method of claim 6 wherein steps (a) through (d) are performed by a programmed computer which includes schedule calculation and operator update programs associated with each mill stand.

12. A method of controlling a multi-stand rolling mill having presettable speed and screwdown parameters for each mill stand, which method comprises:

a. establishing a multi-stand rolling schedule for said stands after receiving input data, b. presetting the mill speed and screwdown parameters for each stand at a corresponding reference level obtained from the rolling schedule and operating the mill parameters at said reference level during an automatic mode of operation, c. calculating a modifier for at least one speed or screwdown preset reference level of at least one mill stand during mill operation, said calculation occurring in response to an operator updating at least one corresponding speed or screwdown preset device, the same preset device being used for a second mode of mill operation, and d. subsequently adjusting at least one speed or screwdown preset reference level of at least one mill stand proportional to a corresponding calculated modifier.

13. The method of claim 12 wherein step (c) is performed by a programmed computer which includes an operator update program associated with each speed or screwdown preset for each mill stand.

14. The method of claim 12 wherein steps (a) through (d) are performed by a programmed computer which includes schedule calculation and operator update programs for each speed or screwdown preset associated with each mill stand.

15. Apparatus for controlling a rolling mill having a presettable operating parameter, comprising:

a. means for controlling mill operation in response to an operating parameter preset signal, b. means receiving input data signals and establishing a rolling schedule, said means generating the parameter preset signal at a reference level determined by the rolling schedule in effect during an automatic mode of mill operation, c. means for calculating a modifier for the parameter preset signal during mill operation in response to an operator updating a parameter preset device, the same preset device being used during a second mode of operation, and d. means for subsequently adjusting the reference level of said parameter preset signal in proportion to the calculated modifier.

16. The apparatus of claim 15 wherein the operating parameter is mill speed.

17. The apparatus of claim 15 wherein the operating parameter is roll screw position.

18. The apparatus of claim 15 wherein means (c) is incorporated in a programmed computer adapted to include an operator update program.

19. The apparatus of claim 15 wherein means (b) through (d) are incorporated in a programmed computer adapted to include schedule calculation and operator update programs.

20. Apparatus for controlling a multi-stand rolling mill having a presettable operating parameter, comprising:

a. means for controlling multi-stand mill operation in response to respective operating parameter preset signals, b. means receiving input data signals and establishing a multi-stand rolling schedule, said means generating individual parameter preset signals at a reference level determined for each stand by the rolling schedule in effect during an automatic mode of mill operation, c. means for calculating a modifier for at least one parameter preset signal during mill operation in response to an operator updating a corresponding parameter preset device, the same preset device being used during a second mode of operation, and d. means for subsequently adjusting the reference level of said parameter preset signal for at least one stand in proportion to the calculated modifier.

21. The apparatus of claim 20 wherein the operating parameter for each stand is mill speed.

22. The apparatus of claim 20 wherein the operating parameter for each stand is roll screw position.

23. The apparatus of claim 20 wherein means (c) is incorporated in a programmed computer adapted to include an operator update program associated with each mill stand.

24. The apparatus of claim 20 wherein means (d) is adapted to adjust the reference level of said parameter preset signals for a plurality of adjacent stands.

25. The apparatus of claim 20 wherein means (b) through (d) are incorporated in a programmed computer adapted to include schedule calculation and operator update programs associated with each mill stand.

26. Apparatus for controlling a multi-stand rolling mill having presettable speed and screwdown parameters for each mill stand, comprising:

a. means for controlling multi-stand mill operation in response to respective speed and screwdown preset signals, b. means receiving input signals and establishing a multi-stand rolling schedule, said means generating individual speed and screwdown preset signals at a reference level determined for each stand by the rolling schedule in effect during an automatic mode of operation, c. means for calculating a modifier for at least one speed or screwdown preset signal for at least one stand during mill operation in response to an operator updating at least one corresponding speed or screwdown preset device, the same preset device being used during a second mode of operation, and d. means for subsequently adjusting the reference level of at least one speed or screwdown preset signal for at least one stand proportional to a corresponding calculated modifier.

27. The apparatus of claim 26 wherein means (c) is incorporated in a programmed computer adapted to include an operator update program associated with each speed or screwdown preset signal for each mill stand.

28. The apparatus of claim 26 wherein means (b) through (d) are incorporated in a programmed computer adapted to include schedule calculation and operator update programs for each speed or screwdown preset associated with each mill stand.

* * * * *